US011543762B2

(12) United States Patent
Taniguchi

(10) Patent No.: US 11,543,762 B2
(45) Date of Patent: Jan. 3, 2023

(54) IMAGE FORMING APPARATUS

(71) Applicant: KYOCERA Document Solutions Inc., Osaka (JP)

(72) Inventor: Susumu Taniguchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/535,239

(22) Filed: Nov. 24, 2021

(65) Prior Publication Data

US 2022/0171312 A1 Jun. 2, 2022

(30) Foreign Application Priority Data

Dec. 2, 2020 (JP) ..... JP2020-199984

(51) Int. Cl.
*G03G 15/16* (2006.01)

(52) U.S. Cl.
CPC ..... *G03G 15/161* (2013.01)

(58) Field of Classification Search
CPC ..... G03G 15/161
See application file for complete search history.

(56) References Cited

U.S. PATENT DOCUMENTS

2008/0122168 A1* 5/2008 Higashimura ..... G03G 15/6558 271/275
2011/0081165 A1* 4/2011 Kwon ..... G03G 15/1615 399/302
2018/0039208 A1 2/2018 Uohashi

FOREIGN PATENT DOCUMENTS

JP 2018-25592 A 2/2018

* cited by examiner

*Primary Examiner* — Clayton E. LaBalle
*Assistant Examiner* — Michael A Harrison
(74) *Attorney, Agent, or Firm* — Stein IP, LLC

(57) ABSTRACT

An image forming apparatus includes a body, a conveyance unit, an image carrier, a transfer unit, and a pre-transfer guide. The body has a sheet passage for conveying sheets along inner and outer conveyance surfaces mutually facing. The conveyance unit includes the outer conveyance surface and is supported pivotably between an open position and a closed position relative to the inner conveyance surface. The transfer unit rotatably supports a transfer roller. The pre-transfer guide includes a first guide on the outer conveyance surface and a second guide on the inner conveyance surface. The first guide has a contact segment protruding toward the second guide. The first guide and the transfer unit are supported independently swingably relative to the transfer unit. The first guide is urged toward the second, and the distance between the two guide surfaces is restricted by the contact segment touching a contacted portion.

7 Claims, 7 Drawing Sheets

IMAGE FORMING APPARATUS

INCORPORATION BY REFERENCE

This application is based on and claims the benefit of priority from Japanese Patent Application No. 2020-199984 filed on Dec. 2, 2020, the contents of which are hereby incorporated by reference.

BACKGROUND

The present disclosure relates to image forming apparatuses, such as copiers, printers, and facsimile machines as well as multifunction peripherals incorporating their functions.

Many known image forming apparatuses such as copiers and printers have a sheet conveyance passage provided vertically near a side surface of the apparatus body to achieve compactness of the apparatus as a whole. In the vertically provided conveyance passage, a pair of conveyance rollers is disposed. It is common to provide a conveyance unit fitted with one of such a pair of conveyance rollers, or a transfer roller kept in pressed contact with an image carrying member to form a transfer nip, or the like and to configure the conveyance unit openable and closable with respect to the apparatus body. This construction permits the conveyance passage to be widely exposed for jam disposal and maintenance work.

Just short of the transfer nip, a pre-transfer guide is provided, and a sheet is guided along the pre-transfer guide to the transfer nip. One important target to be managed in image formation at the transfer nip is the gap between a conveyance unit-side guide, which is a part of the pre-transfer guide, and a body-side guide, which is disposed at a position opposite the conveyance unit-side guide.

SUMMARY

According to one aspect of the present disclosure, an image forming apparatus includes an apparatus body, a cover member, a conveyance unit, an image carrying member, a transfer roller, a transfer unit, a first urging member, and a pre-transfer guide. The apparatus body has a sheet conveyance passage through which sheets are conveyed along a pair of conveyance surfaces that face each other. The cover member is supported so as to be openable and closable with respect to the apparatus body. The conveyance unit is disposed inside the cover member in the apparatus body, includes an outer conveyance surface forming an outer surface of the sheet conveyance passage, and is supported so as to be pivotable between an open position and a closed position with respect to the inner conveyance surface forming an inner surface of the sheet conveyance passage. The image carrying member is rotatably disposed on the inner conveyance surface, and has a toner image formed on its surface. The transfer roller is disposed on the outer conveyance surface of the conveyance unit so as to face the image carrying member such that, with the conveyance unit in the closed position, the transfer roller is in pressed contact with the image carrying member to form a transfer nip, thereby to allow the toner image to be transferred to the sheet passing through the transfer nip. The transfer unit is supported so as to be swingable with respect to the outer conveyance surface of the conveyance unit, and rotatably supports the transfer roller. The first urging member urges the transfer unit in a direction in which the transfer roller is pressed against the image carrying member. The pre-transfer guide is disposed closely upstream of the transfer nip with respect to the sheet conveyance direction, and includes a first guide disposed on the outer conveyance surface and a second guide disposed opposite the first guide on the inner conveyance surface. The first guide is supported on the outer conveyance surface so as to be movable in directions approaching and receding from the second guide, and has a first guide surface that guides a sheet toward the transfer nip and a contact segment that protrudes from the first guide surface toward the second guide. The second guide has a second guide surface that faces the first guide surface and a contacted portion that is formed at a position on the second guide surface opposite the contact segment. The first guide and the transfer unit are supported so as to be swingable independently of each other with respect to the outer conveyance surface. The first guide is urged by a second urging member in a direction approaching the second guide such that, with the conveyance unit disposed in the closed position, the distance between the first and second guide surfaces is restricted by the contact segment making contact with the contacted portion.

DETAILED DESCRIPTION

Figure 1:
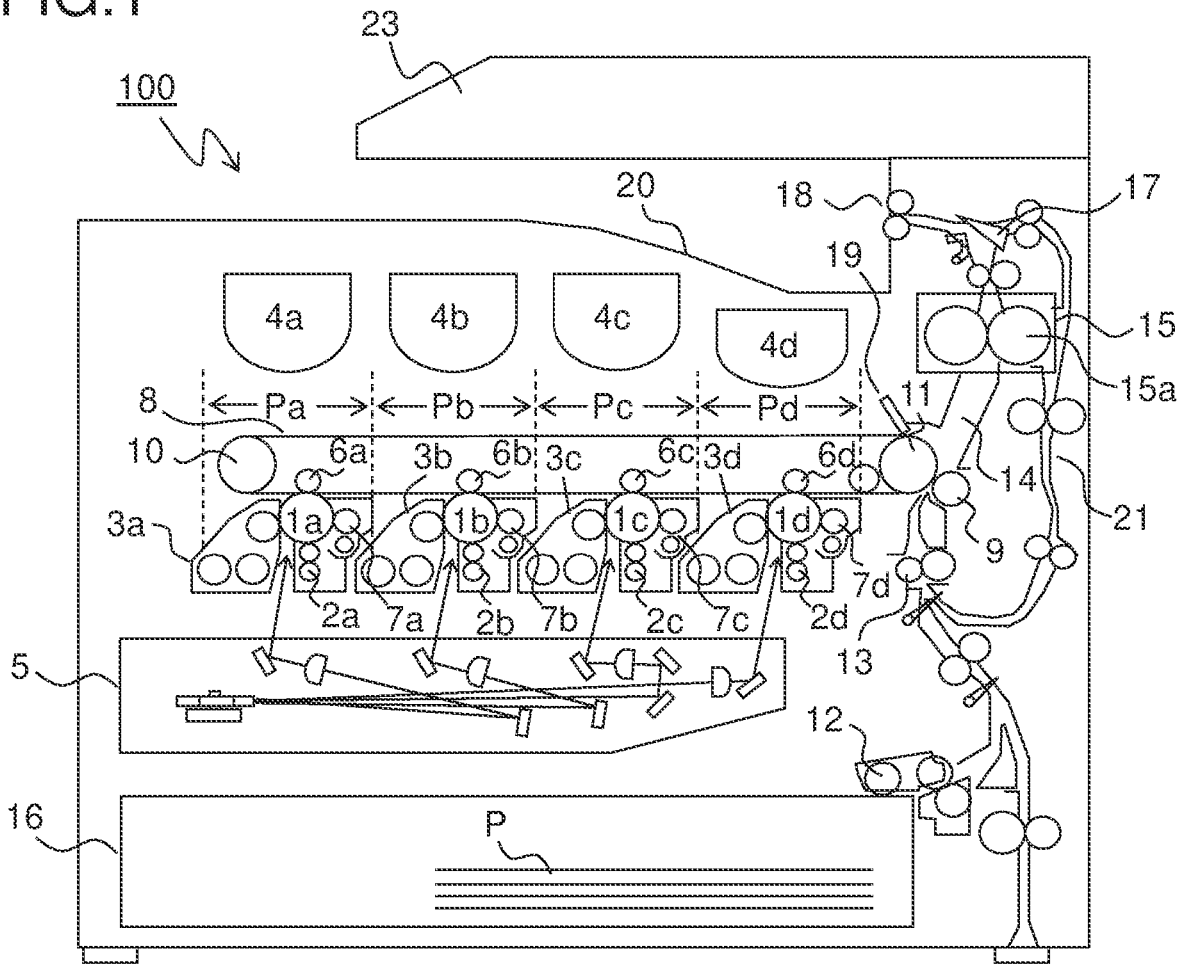
FIG. 1 is a schematic sectional view of an image forming apparatus according to an embodiment of the present disclosure, showing its overall construction.

Hereinafter, an embodiment of the present disclosure will be described with reference to the accompanying drawings. FIG. 1 is a sectional view of an image forming apparatus 100 according to one embodiment of the present disclosure, showing an outline of its construction. In the embodiment, the image forming apparatus 100 is a four-stage tandem-type color copier that performs image formation with four photosensitive drums 1*a*, 1*b*, 1*c*, and 1*d* disposed side by side for four different colors (magenta, cyan, yellow, and black).

In the apparatus body of the image forming apparatus 100, four image forming portions Pa, Pb, Pc, and Pd are arranged in this order from left to right in FIG. 1. These image forming portions Pa to Pd are provided for images of the four different colors (magenta, cyan, yellow, and black), and sequentially form a magenta, a cyan, a yellow, and a black image each through the processes of electrostatic charging, exposure to light, image development, and image transfer.

In these image forming portions Pa to Pd respectively, the above-mentioned photosensitive drums 1*a* to 1*d* are arranged for carrying visible images (toner images) of the different colors. An intermediate transfer belt 8 that rotates counter-clockwise in FIG. 1 is provided adjacent to the image forming portions Pa to Pd. Toner images formed on these photosensitive drums 1*a* to 1*d* are sequentially transferred to the intermediate transfer belt 8 that moves while in contact with the photosensitive drums 1*a* to 1*d*. The toner images transferred to the intermediate transfer belt 8 are, at a secondary transfer roller 9, at once transferred to a sheet P, and are, in a fixing device 15, fixed to the sheet P, which is then discharged out of the image forming apparatus 100. While the photosensitive drums 1*a* to 1*d* are rotated clockwise in FIG. 1, an image forming process is performed with respect to each of the photosensitive drums 1*a* to 1*d*.

Sheets P to which toner images are to be transferred are stored in a sheet cassette 16 disposed in a lower part of the body of the image forming apparatus 100, and are conveyed via a sheet teed roller 12, a pair of registration rollers 13, and a sheet conveyance passage 14 to the secondary transfer roller 9. Used as the intermediate transfer belt 8 is a sheet made of a dielectric resin, and typically is a belt with no seams (seamless belt). The intermediate transfer belt 8 and the secondary transfer roller 9 are driven by a belt drive motor (not illustrated) to rotate at the same linear velocity as the photosensitive drums 1*a* to 1*d*. Downstream of the secondary transfer roller 9, a blade-form belt cleaner 19 is disposed for removing the toner and other residues that are left behind on the surface of the intermediate transfer belt 8.

Next, the image forming portions Pa to Pd will be described. Around and under the photosensitive drums 1*a* to 1*d*, which are rotatably arranged, there are provided charging devices 2*a*, 2*b*, 2*c*, and 2*d* for electrostatically charging the photosensitive drums 1*a* to 1*d*, an exposure unit 5 for exposing the photosensitive drums 1*a* to 1*d* to light based on image data, developing devices 3*a*, 3*b*, 3*c*, and 3*d* for developing, with toner, electrostatic latent images formed on the photosensitive drums 1*a* to 1*d*, and cleaning devices 7*a*, 7*b*, 7*c*, and 7*d* for collecting and removing the developer (toner) that is left behind on the photosensitive drums 1*a* to 1*d* after the transfer of the toner images.

An image reading portion 23 includes (though none is illustrated) a scanning optical system comprising a scanner lamp for illuminating a document during copying and a mirror for deflecting the optical path of the light reflected from the document, a converging lens for converging and focusing the light reflected from the document, and a CCD sensor for converting the focused image light into an electrical signal, or the like. The image reading portion 23 reads the document image and converts it into image data.

In copying operation, the image reading portion 23 reads the image data of a document and converts it into a read image signal. On the other hand, the charging devices 2*a* to 2*d* electrostatically charges the surfaces of the photosensitive drums 1*a* to 1*d* uniformly. Subsequently, the exposure unit 5 irradiates the surfaces of the photosensitive drums 1*a* to 1*d* with light based on the image data, and thereby forms electrostatic latent images based on the image data on the photosensitive drums 1*a* to 1*d*. The developing devices 3*a* to 3*d* include developing rollers (developer carrying members) disposed opposite the photosensitive drums 1*a* to 1*d*, and are loaded with predetermined amounts of two-component developer containing toner of different colors, namely magenta, cyan, yellow, and black.

As toner images are formed as will be described later, when the proportion of toner in the two-component developer loaded in the developing devices 3*a* to 3*d* falls below a prescribed value, developer is supplied from containers 4*a* to 4*d* to the developing devices 3*a* to 3*d*. The toner in the developer is fed by the developing devices 3*a* to 3*d* onto the photosensitive drums 1*a* to 1*d* and electrostatically attaches to them; this forms toner images based on the electrostatic latent images formed through exposure to the light from the exposure unit 5.

Then primary transfer rollers 6*a* to 6*d* apply a predetermined transfer voltage between the primary transfer rollers 6*a* to 6*d* and the photosensitive drums 1*a* to 1*d*. This causes the magenta, cyan, yellow, and black toner images on the photosensitive drums 1*a* to 1*d* to be primarily transferred to the intermediate transfer belt 8. These images of four colors are formed in a predetermined positional relationship that is prescribed to form a predetermined full-color image. The primary transfer rollers 6*a* to 6*d* are driven by a primary transfer motor (not illustrated) to rotate at the same linear velocity as the photosensitive drums 1*a* to 1*d* and the intermediate transfer belt 8. Then, in preparation to the subsequent formation of new electrostatic latent images, the toner that is left behind on the surfaces of the photosensitive drums 1*a* to 1*d* is removed by the cleaning devices 7*a* to 7*d*.

The intermediate transfer belt 8 is stretched around a driven roller 10 and a driving roller 11. When, as the driving roller 11 is driven to rotate by the belt drive motor, the intermediate transfer belt 8 starts to rotate counter-clockwise, a sheet P is conveyed from the pair of registration rollers 13, with predetermined timing, to the nip (secondary transfer nip N in FIG. 2) between the secondary transfer roller 9, which is provided adjacent to the intermediate transfer belt 8, and the intermediate transfer belt 8. At the nip, the full-color image is secondarily transferred to the sheet P. The sheet P having the toner images transferred to it is conveyed through the sheet conveyance passage 14 to the fixing device 15. Through the sheet conveyance passage 14, the sheet P is conveyed along a pair of conveyance surfaces (an outer conveyance surface 14*a* and an inner conveyance surface 14*b* in FIG. 2) that face each other in the horizontal direction.

While the sheet P conveyed to the fixing device 15 passes through the nip (fixing nip) in a pair of fixing rollers 15*a*, the sheet P is heated and pressed, so that the toner images are fixed to the surface of the sheet P; thus the predetermined full-color image is formed. The sheet P having the predetermined full-color image firmed on it is diverted in an appropriate conveyance direction by a branch portion 17 that branches into a plurality of directions. In a case where an image is to be formed on only one side of a sheet P, the sheet P is discharged as it is onto a discharge tray 20 by a pair of discharge rollers 18.

By contrast, in a case where images are to be formed on both sides of a sheet P, part of the sheet P having passed through the fixing device 15 is momentarily stuck out of the apparatus through the pair of discharge rollers 18. Then the pair of discharge rollers 18 is rotated reversely, so that the sheet P is diverted by the branch portion 17 into a reversal conveyance passage 21; thus the sheet P is conveyed, now with the image side reversed, once again to the secondary transfer roller 9. Then the next image formed on the intermediate transfer belt 8 is transferred by the secondary transfer roller 9 to the side of the sheet P on which no image has been formed yet. The sheet P is then conveyed to the fixing device 15, where the toner images are fixed to it, and is then discharged by the pair of discharge rollers 18 onto the discharge tray 20.

Figure 2:
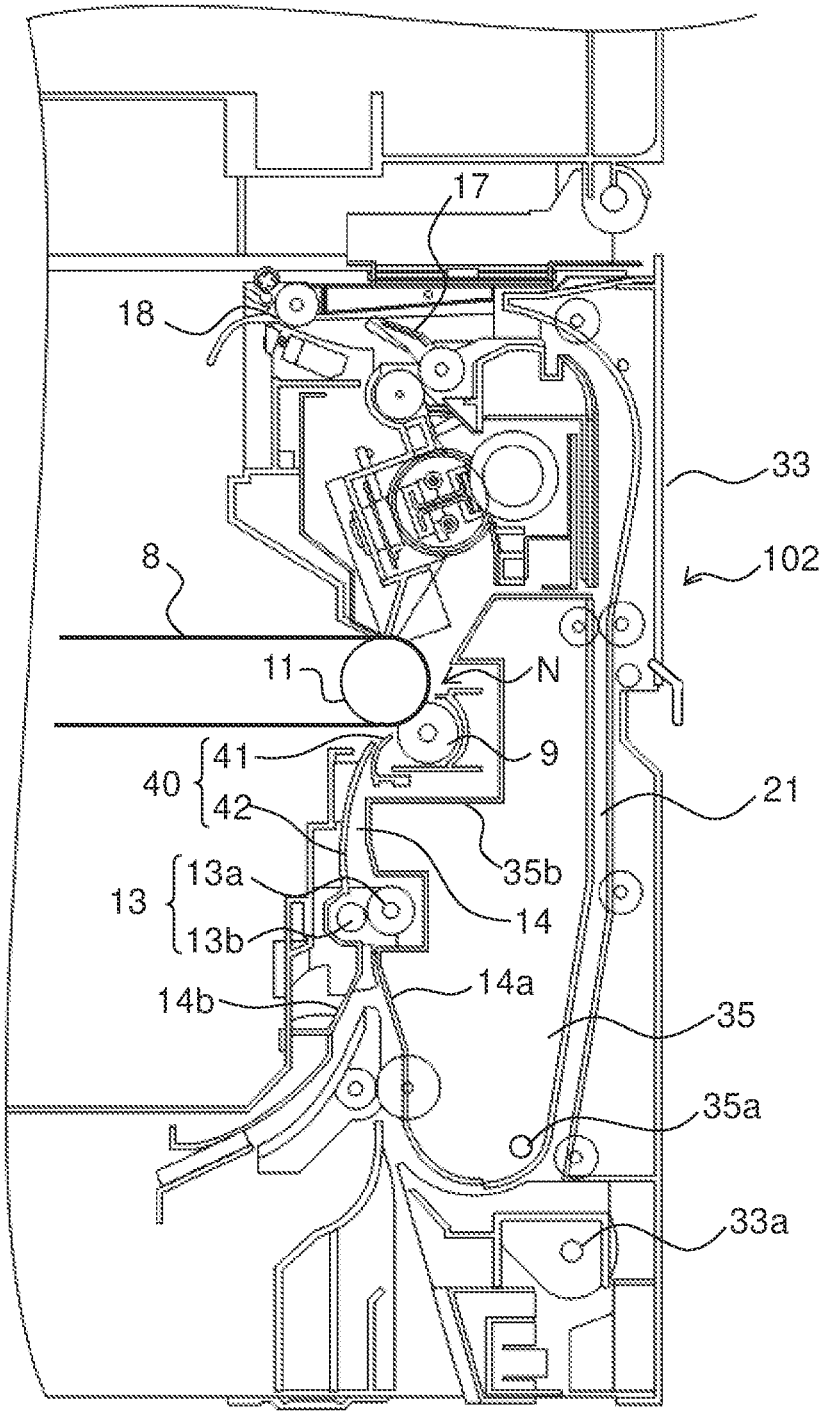
FIG. 2 is a sectional view around a sheet conveyance passage and a reversal conveyance passage in the image forming apparatus according to the embodiment.
Figure 3:
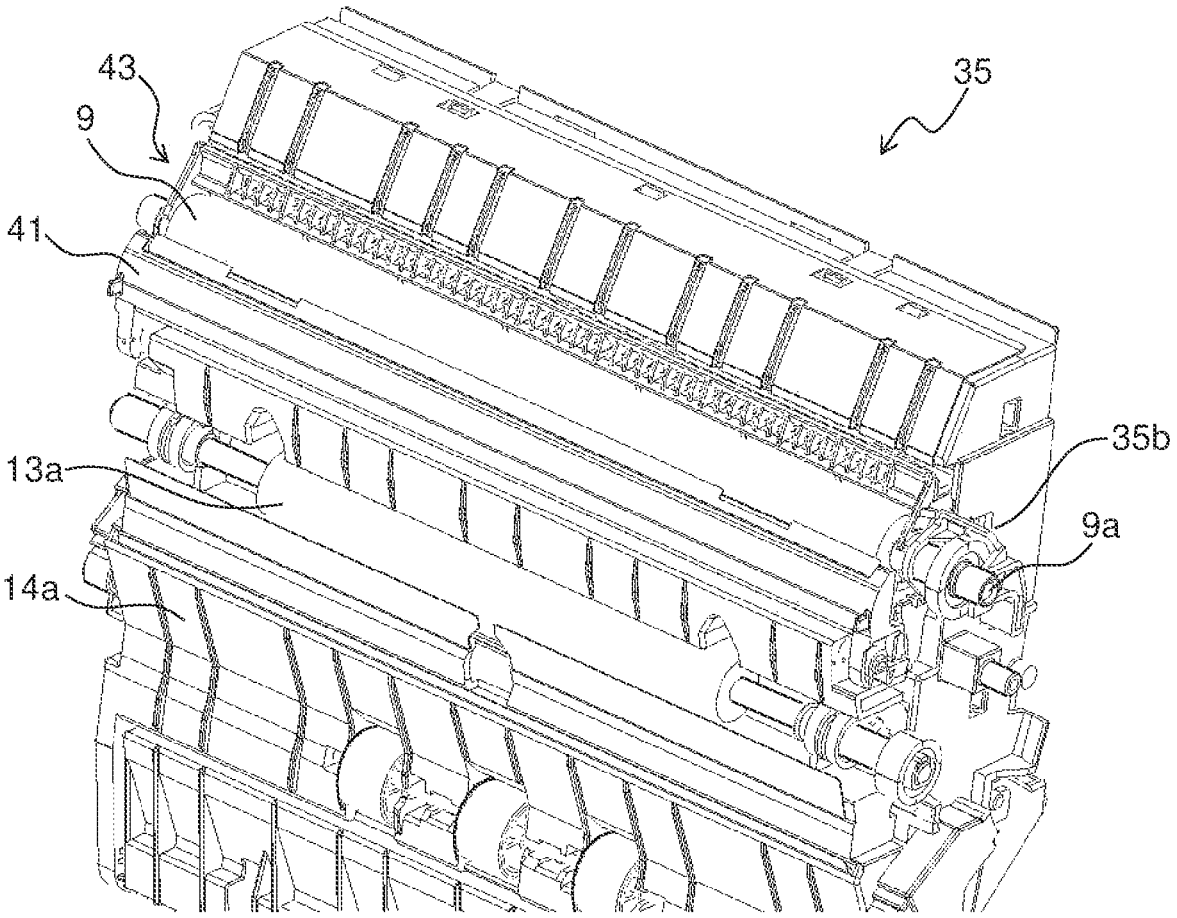
FIG. 3 is a perspective view of a side cover and a conveyance unit as seen from inside the image forming apparatus.

FIG. 2 is a sectional view around the sheet conveyance passage 14 and the reversal conveyance passage 21 in the image forming apparatus 100. FIG. 3 is a perspective view of a side cover 33 and a conveyance unit 35 as seen from inside the image forming apparatus 100 (from the left side in FIG. 2).

The side cover 33 constitutes a side surface 102 of the image forming apparatus 100, and is pivotably supported on a pivot 33*a* provided in a lower part of the body of the image forming apparatus 100. The inner side surface of the side cover 33 constitutes one conveyance surface of the reversal conveyance passage 21. Pivoting only the side cover 33 in the opening direction with respect to the image forming apparatus 100 permits the reversal conveyance passage 21 to be widely exposed. By contrast, pivoting the side cover 33 along with the conveyance unit 35 in the opening direction results in the outer conveyance surface 14*a,* which is the inner side surface of the conveyance unit 35, moving away from the inner conveyance surface 14*b* of the body of the image forming apparatus 100, and thus permits the sheet conveyance passage 14 to be widely exposed. On the other hand, pivoting the side cover 33 along with the conveyance unit 35 in the closing direction causes the outer conveyance surface 14*a* of the conveyance unit 35 to face the inner conveyance surface 14*b* of the body of the image forming apparatus 100, and thus results in the secondary transfer roller 9 being pressed against the driving roller 11.

Inward of the side cover 33, the conveyance unit 35 is disposed. The conveyance unit 35 is supported on the body of the image forming apparatus 100 so as to be pivotable about a pivot shaft 35*a,* and constitutes the reversal conveyance passage 21 and the outer conveyance surface 14*a* of the sheet conveyance passage 14. The reversal conveyance passage 21 extends vertically along the side surface 102 of the image forming apparatus 100 between the side cover 33 and the conveyance unit 35, and then curves substantially in a C-shape to meet the sheet conveyance passage 14.

Closely upstream of the secondary transfer nip N in the sheet conveyance direction, a pre-transfer guide 40 is provided that guides the leading end of a sheet P that is about to enter the secondary transfer nip N. The pre-transfer guide 40 comprises a first guide 41 disposed on the outer conveyance surface 14*a* of the conveyance unit 35 and a second guide 42 disposed on the inner conveyance surface 14*b* of the body of the image forming apparatus 100. The structure of the first and second guides 41 and 42 will be described in detail later.

The outer conveyance surface 14*a,* which is the inner side surface of the conveyance unit 35, is fitted with, in order from upstream in the sheet conveyance direction (from bottom in FIG. 2), a first roller 13*a* in the pair of registration rollers 13, the first guide 41 in the pre-transfer guide 40, and the secondary transfer roller 9. The secondary transfer roller 9 is pressed against the driving roller 11 with the intermediate transfer belt 8 in between.

When a jam in the reversal conveyance passage 21 has to be coped with, pivoting only the side cover 33 clockwise from the state in FIG. 2 leaves the reversal conveyance passage 21 open. By contrast, when a jam in the sheet conveyance passage 14 has to be coped with, pivoting the side cover 33 along with the conveyance unit 35 clockwise results in the conveyance unit 35 being disposed in a position (an open position) where its outer conveyance surface 14*a* is located away from the inner conveyance surface 14*b* of the body of the image forming apparatus 100, leaving the sheet conveyance passage 14 open. In this state, the secondary transfer roller 9 is located away from the driving roller 11, and the first roller 13*a* in the pair of registration rollers 13 is located away from a second roller 13*b*.

After the removal of the sheet P, pivoting the conveyance unit 35 and the side cover 33 counter-clockwise in FIG. 2 back to the state in FIG. 2 (a closed position) results in the conveyance unit 35 being disposed at such a position that the secondary transfer roller 9 is in pressed contact with the driving roller 11 and the first roller 13*a* is in pressed contact with the second roller 13*b*.

Figure 4:
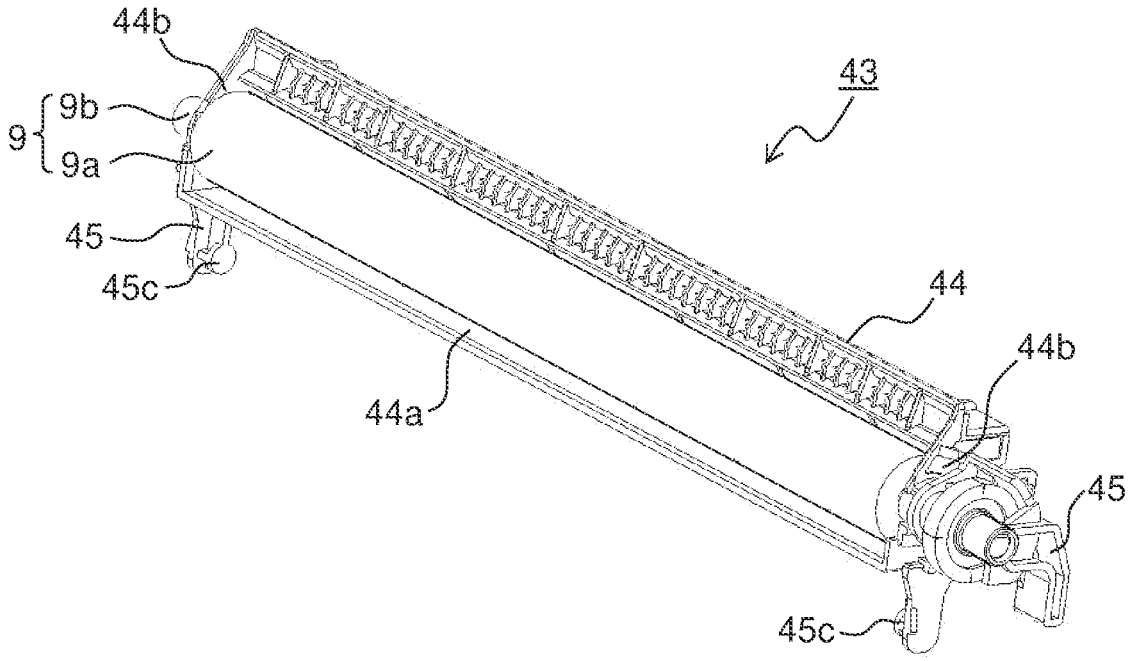
FIG. 4 is a perspective view of a secondary transfer unit mounted on the conveyance unit.
Figure 5:
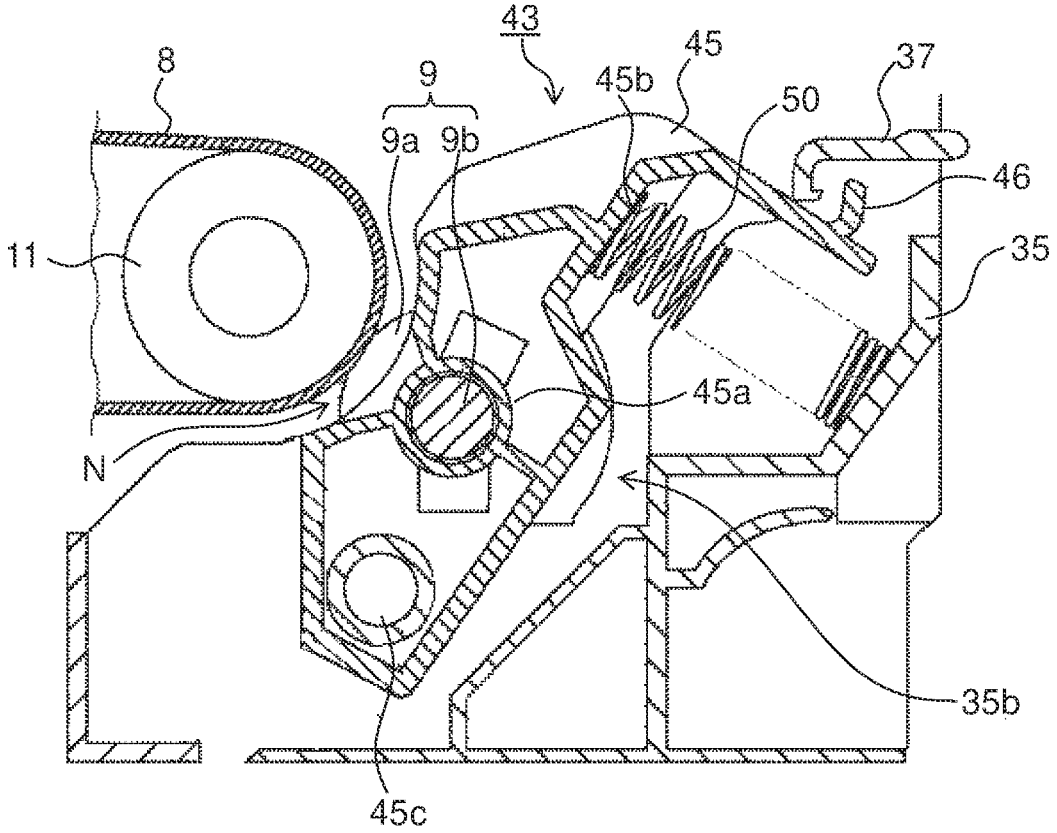
FIG. 5 is a side sectional view around a lever of the secondary transfer unit accommodated in an accommodating recess in the conveyance unit.
Figure 6:
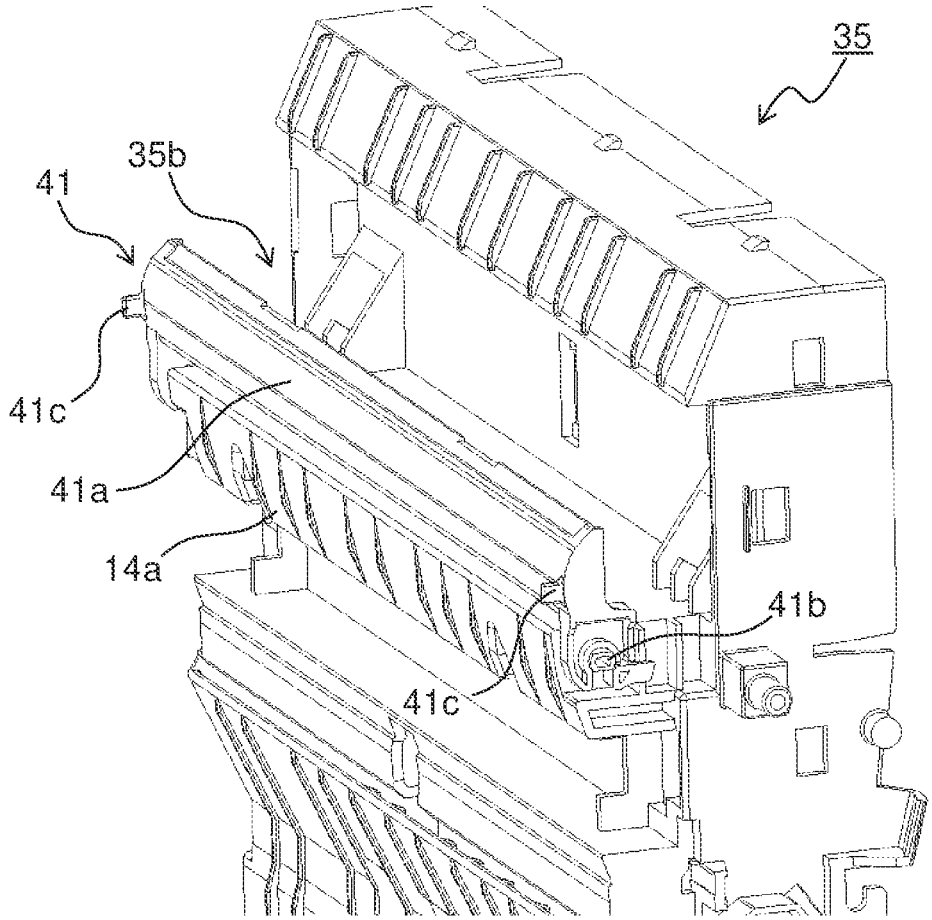
FIG. 6 is a perspective view of the conveyance unit with the secondary transfer unit removed.

FIG. 4 is a perspective view of a secondary transfer unit 43 that is mounted on the conveyance unit 35. FIG. 5 is a side sectional view around a lever 45 of the secondary transfer unit 43 accommodated in an accommodating recess 35*b* in the conveyance unit 35. FIG. 6 is a perspective view of the conveyance unit 35 with the secondary transfer unit 43 removed. As shown in FIG. 4, the secondary transfer unit 43 (transfer unit) includes the secondary transfer roller 9 that is kept in pressed contact with the intermediate transfer belt 8 to form the secondary transfer nip N, a holder 44 that rotatably supports the secondary transfer roller 9, and a pair of levers 45 that keeps the secondary transfer roller 9 in pressed contact with the driving roller 11 with the intermediate transfer belt 8 in between.

The secondary transfer roller 9 has a roller portion 9*a* that is formed of an electrically conductive elastic material and a rotary shaft 9*b* that extends along the axial direction of the roller portion 9*a.* The secondary transfer roller 9 is electrically connected to a transfer voltage source (not illustrated), and is fed with a predetermined secondary transfer voltage of the polarity opposite to that of toner when the full-color toner image formed on the intermediate transfer belt 8 is secondarily transferred to the sheet P at the secondary transfer nip N.

The holder 44 has an accommodating portion 44*a* that is provided along part of the circumferential surface of the secondary transfer roller 9 and that is arc-shaped as seen in a cross-sectional view and a pair of pivot portions 44*b* that are provided respectively in opposite end parts of the accommodating portion 44*a.* The pivot portions 44*b* have respectively formed in them bearing holes (not illustrated) that pivotally support opposite end parts of the rotary shaft 9*b* of the secondary transfer roller 9.

The pair of levers 45 are mounted on opposite end parts of the holder 44 in the axial direction, and each have a bearing part 45*a* that pivotally supports one end part of the rotary shaft 9*b* of the secondary transfer roller 9, a spring seat part 45*b* that holds one end of a compression spring 50 (first urging member) fitted to the conveyance unit 35, and a swing fulcrum 45*c* that is provided at the side of the bearing part 45*a* opposite from the spring seat part 45*b*.

The bearing part 45*a* has a cylindrical shape, and is so formed that one end part of the rotary shaft 9*b* is inserted through the bearing part 45*a* and that the bearing part 45*a* is insertable through the bearing hole formed in the pivot portion 44*b* of the holder 44. The spring seat part 45*b* is formed in the shape of a circular recess at the rear side (right side in FIG. 5) of the lever 45. At the tip end of the spring seat part 45*b,* a hook portion 46 is provided. As shown in FIG. 4, the swing fulcrum 45*c* has the shape of a boss that protrudes inward from a lower end part of the lever 45. The secondary transfer unit 43 is supported so as to be swingable about the swing fulcrum 45*c* with respect to the conveyance unit 35.

As shown in FIGS. 5 and 6, the accommodating recess 35*b* is formed so as to he recessed from the outer conveyance surface 14*a*. In lower parts of the opposite side surfaces of the accommodating recess 35*b*, a pair of engagement holes (not illustrated) is provided for rotatable engagement with the swing fulcrums 45*c*. On opposite end parts of the bottom surface of the accommodating recess 35*b*, one ends of the compression springs 50 as an urging member for urging the levers 45 are supported respectively. Over the compression springs 50 respectively, engagement portions 37 are formed.

Inserting the swing fulcrums 45*c* formed on the pair of levers 45 from above into the engagement holes formed in the opposite side surfaces of the accommodating recess 35*b* permits the secondary transfer unit 43 to be supported such that the secondary transfer unit 43 is slidable vertically along the engagement holes and in addition that the secondary transfer unit 43 is pivotable about the swing fulcrums 45*c*. Then locking the hook portions 46 of the pair of levers 45 in the engagement portions 37 formed in the accommodating recess 35*b* permits the other ends of the compression springs 50 to rest in the spring seat parts 45*b* in the levers 45 respectively.

The compression spring 50 urges the lever 45 counter-clockwise in FIG. 5 about the swing fulcrum 45*c*. The lever 45 urges the secondary transfer roller 9 toward the rotational center of the driving roller 11. The direction in which the secondary transfer roller 9 is urged is restricted by a rail-like structure (not illustrated) formed on the body of the image forming apparatus 100. The upward movement of the secondary transfer unit 43 is restricted by the hook portion 46 and the engagement portion 37, and the downward movement of the secondary transfer unit 43 is restricted by the accommodating recess 35*b*.

As shown in FIG. 6, the first guide 41 is fitted to a downstream end part (left end part in FIG. 6) of the accommodating recess 35*b* with respect to the rotation of the conveyance unit 35 in the closing direction. The first guide 41 has a guide surface 41*a* that is formed so as to curve obliquely upward rightward along the sheet conveyance passage 14, a pair of swing shafts 41*b* that are formed in opposite end parts of the guide surface 41*a* in its longitudinal direction (sheet width direction) and that are swingably supported on the conveyance unit 35, and a pair of contact segments 41*c* that protrude toward the second guide 42 (leftward in FIG. 6) from a position away from the swing shafts 41*b* toward the swinging end (upward in FIG. 6).

Figure 7:
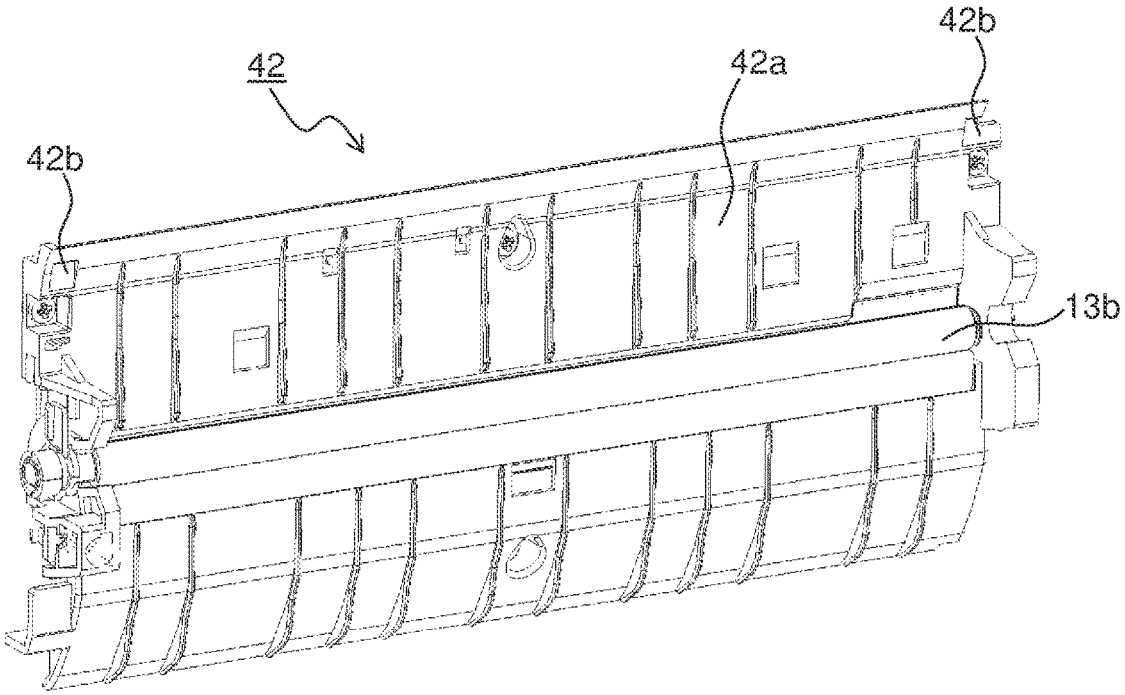
FIG. 7 is a perspective view of a second guide as seen from the direction of a first guide.
Figure 8:
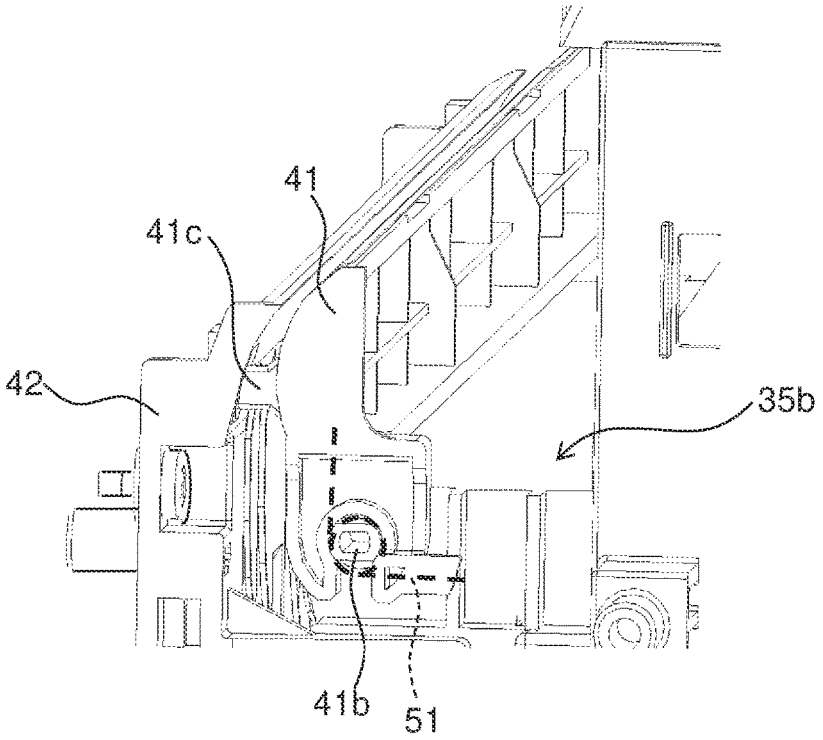
FIG. 8 is a perspective view of the first and second guides in a pre-transfer guide, in a state in contact with each other.

The swing shaft 41*b* is fitted with a torsion spring 51 (second urging member see FIG. 8). The first guide 41 is urged by the urging force of the torsion spring 51 in a direction approaching the second guide 42 (counter-clockwise in FIG. 6). The contact segment 41*c* is configured to protrude by a dimension greater than the clearance between the first and second guides 41 and 42 as observed with the first guide 41 closest to the second guide 42 within the swingable range. Thus, with the conveyance unit 35 disposed in the closed position (see FIG. 2, the contact segment 41*c* is always in contact with a contacted portion 42*b* (see FIG. 7) of the second guide 42, and thereby restricts the clearance between the first guide 41, which is urged by the torsion spring 51, and the second guide 42.

FIG. 7 is a perspective view of the second guide 42 in the pre-transfer guide 40 as seen from the direction of the first guide 41. The second guide 42 is fastened with screws to the inner conveyance surface 14*b* of the body of the image forming apparatus 100, and has a second guide surface 42*a* that faces the first guide surface 41*a* of the first guide 41 and a contacted portion 42*b* that is formed at a position on the second guide surface 42*a* opposite the contact segment 41*c*. The contacted portion 42*b* is a recess formed in the second guide surface 42*a*. The second guide 42 rotatably supports the second roller 13*b* in the pair of registration rollers 13.

Next, the operation of pivoting the conveyance unit 35 to close the sheet conveyance passage 14 will be described. Pivoting counter-clockwise in FIG. 2 the side cover 33 and the conveyance unit 35 in the open state brings the first and second rollers 13*a* and 13*b* in the pair of registration rollers 13 into pressed contact with each other. Meanwhile the secondary transfer roller 9 is brought into pressed contact with the driving roller 11 to form the secondary transfer nip N against the intermediate transfer belt 8.

Figure 9:
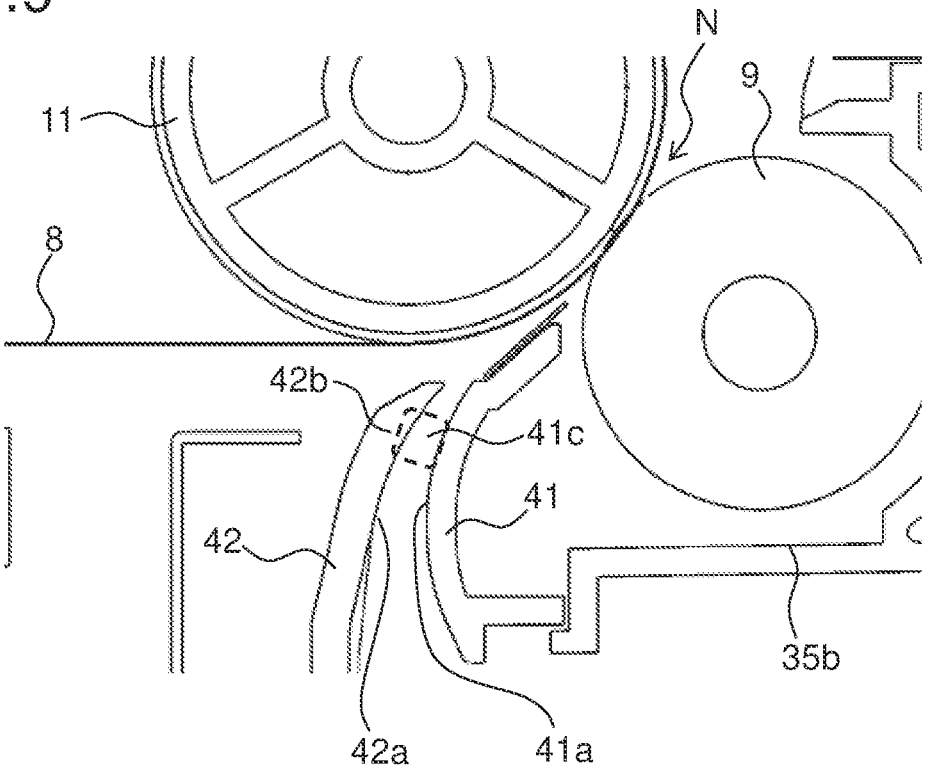
FIG. 9 is a side sectional view around a secondary transfer nip between the first and second guides in a state in contact with each other.

FIG. 8 is a perspective view showing the first and second guides 41 and 42 in a state in contact with each other. FIG. 9 is a side sectional view around the secondary transfer nip N between the first and second guides 41 and 42 in a state in contact with each other. With the conveyance unit 35 disposed in the closed position, as shown in FIGS. 8 and 9, the contact segment 41*c* on the first guide 41 is in contact with the contacted portion 42*b* of the second guide 42, maintaining a fixed distance between the first and second guide surfaces 41*a* and 42*a*.

In this state, a hook on the side cover 33 engages with an engagement pin on the body of the image forming apparatus 100 (neither is illustrated), so that the side cover 33 is held in the closed state. Thus the conveyance unit 35 is positioned in a predetermined position (closed position) inside the body of the image forming apparatus 100.

In a known construction where the first guide 41 is fitted directly to the secondary transfer unit 43, variations in the hardness and the outer diameter of the roller portion 9*a* of the secondary transfer roller 9 cause variation of the position of the secondary transfer unit 43. This may in turn cause variation of the position of the first guide 41 fitted to the secondary transfer unit 43 and hence variation of the clearance (distance) between the first and second guide surfaces 41*a* and 42*a*. Too small a clearance can lead to an increased load (braking force) in sheet conveyance, and too large a clearance can lead to variation of the behavior of the trailing end of a sheet and hence an image defect.

In the embodiment, the secondary transfer unit 43, which holds the secondary transfer roller 9, and the first guide 41, which is a part of the pre-transfer guide 40, are separately fitted to the outer conveyance surface 14*a* of the conveyance unit 35, and the secondary transfer unit 43 and the first guide 41 are supported so as to be swingable independently of each other with respect to the outer conveyance surface 14*a*, of the conveyance unit 35.

The first guide 41 is urged by the torsion spring 51 in a direction approaching the second guide 42, and the first guide 41 has formed on it the contact segment 41*c* that makes contact with the contacted portion 42*b* of the second guide 42. The contact segment 41*c* is configured to protrude by a dimension greater than the clearance between the first and second guide surfaces 41*a* and 42*a* as observed with the conveyance unit 35 disposed in a predetermined position.

With this structure, regardless of variations in the hardness and the outer diameter of the secondary transfer roller 9, simply positioning the conveyance unit 35 determines the position of the first guide 41. This makes it possible to maintain a fixed clearance between the first and second guide surfaces 41*a* and 42*a* it is thus possible to suppress image defects resulting from variation of the load in sheet conveyance, and variation of the clearance between the first and second guides 41 and 42 in the pre-transfer guide 40.

The contact segment 41*c* is configured to protrude by a dimension greater than the clearance between the first and second guide surfaces 41*a* and 42*a* as observed with the first guide 41 closest to the second guide 42 within the swingable range. Thus the contact segment 41*c* is always in contact with the contacted portion 42*b*. Hence the first guide 41 is held in a state pushed back in a direction receding from the second guide 42 against the urging force of the torsion spring 51. It is thus possible to accurately restrict the clearance between the first and second guides 41 and 42 with the dimension of protrusion of the contact segment 41*c*.

Configuring the contacted portion 42*b* of the second guide 42 as a recess formed in the second guide surface 42*a* permits the contact segment 41*c* to be reliably held on the contacted portion 42*b* as the first guide 41 swings. That is, the position at which the contact segment 41*c* makes contact with the second guide surface 42*a* does not change, and this makes it possible to stably maintain the clearance between the first and second guide surfaces 41*a* and 42*a*.

The embodiment described above is not meant to limit the scope of the present disclosure, which thus allows for any modifications within the spirit of the present disclosure. For example, while in the embodiment described above the levers 45 are fitted to opposite end parts of the secondary transfer unit 43 and the secondary transfer unit 43 is urged toward the driving roller 11 via the levers 45 with the compression springs 50, the levers 45 may be omitted, in which case the secondary transfer unit 43 can be urged directly with the compression springs 50.

While the embodiment described above deals with application to clearance adjustment for the pre-transfer guide 40 at the secondary transfer nip N between the secondary transfer roller 9 and the intermediate transfer belt 8, application is also possible to clearance adjustment for a pre-transfer guide at the transfer nip between a transfer roller and a photosensitive drum in an image forming apparatus of a direct-transfer type.

The present disclosure finds applications in image forming apparatuses, such as copiers, printers, and facsimile machines as well as multifunction peripherals incorporating their functions. Based on the present disclosure, it is possible to provide an image forming apparatus that can suppress variation of the position of a guide member for guiding a sheet to the transfer nip and that can thus guide the sheet to the transfer nip with a fixed alignment during conveyance.

What is claimed is:

1. An image forming apparatus comprising:

an apparatus body having a sheet conveyance passage through which a sheet is conveyed along a pair of conveyance surfaces that face each other;

a cover member supported so as to be openable and closable with respect to the apparatus body;

a conveyance unit disposed inside the cover member in the apparatus body, the conveyance unit including an outer conveyance surface forming an outer surface of the sheet conveyance passage, the conveyance unit being supported so as to be pivotable between an open position and a dosed position with respect to an inner conveyance surface forming an inner surface of the sheet conveyance passage;

an image carrying member rotatably disposed on the inner conveyance surface, the image carrying member having a toner image formed on a surface thereof;

a transfer roller disposed on the outer conveyance surface of the conveyance unit so as to face the image carrying member such that, with the conveyance unit in the dosed position, the transfer roller is in pressed contact with the image carrying member to form a transfer nip, thereby to allow the toner image to be transferred to the sheet passing through the transfer nip;

a transfer unit supported so as to be swingable with respect to the outer conveyance surface of the conveyance unit, the transfer unit rotatably supporting the transfer roller;

a first urging member that urges the transfer unit in a direction in which the transfer roller is pressed against the image carrying member; and a pre-transfer guide including a first guide disposed on the outer conveyance surface and a second guide disposed opposite the first guide on the inner conveyance surface, with a tip end of the first guide extending, with respect to a sheet conveyance direction, further downstream beyond a tip end of the second guide, wherein the tip end of the first guide is disposed closely upstream of the transfer nip, wherein the first guide is supported on the outer conveyance surface so as to be movable in directions approaching and receding from the second guide, the first guide having a first guide surface that guides the sheet toward the transfer nip and a contact segment that protrudes from the first guide surface toward the second guide, the second guide has a second guide surface that is fastened to the inner conveyance surface and that faces the first guide surface and a contacted portion that is formed at a position on the second guide surface facing the contact segment, the first guide and the transfer unit are supported so as to be swingable independently of each other with respect to the outer conveyance surface, and the first guide is urged by a second urging member in a direction approaching the second guide such that, with the conveyance unit disposed in the dosed position, a distance between the first and second guide surfaces is restricted by the contact segment making contact with the contacted portion.

2. The image forming apparatus according to claim 1, wherein the first guide is supported by a swing shaft formed in each end part of the first guide surface in a sheet width direction orthogonal to the sheet conveyance direction so as to be swingable in directions approaching and receding from the second guide, and the second urging member is a torsion spring fitted on the swing shaft.

3. The image forming apparatus according to claim 1, wherein the contact segment includes a pair of contact segments formed in opposite end parts of the first guide surface in a sheet width direction.

4. The image for apparatus according to claim 1, wherein the contacted portion is configured to be a recess that is formed at a position opposite the contact segment on the second guide surface and that is slightly larger than a tip end of the contact segment.

5. The image forming apparatus according to claim 1, wherein the transfer unit is swingably supported in an accommodating recess formed so as to be recessed from the outer conveyance surface of the conveyance unit, and the first guide is swingably supported in a downstream end part of the accommodating recess with respect to a pivoting direction of the conveyance unit pivoting toward the closed position.

6. The image forming apparatus according to claim 1, wherein the image carrying member is configured to be an intermediate transfer belt on which the toner image is carried, and the toner image primarily transferred to the intermediate transfer belt is secondarily transferred to the sheet at the transfer nip formed between the transfer roller and the intermediate transfer belt.

7. The image forming apparatus according to claim 4, wherein a protruding amount of the contact segment protrudes is larger than a clearance between the first and second guides as observed with the first guide closest to the second guide within a swingable range.

* * * * *